US012768064B2

(12) United States Patent
Mikami et al.

(10) Patent No.: US 12,768,064 B2
(45) Date of Patent: Oct. 20, 2026

(54) ZINC-NICKEL-SILICA COMPOSITE PLATING BATH AND METHOD FOR PLATING USING SAID PLATING BATH

(71) Applicant: DIPSOL CHEMICALS CO., LTD., Tokyo (JP)

(72) Inventors: Masayoshi Mikami, Nagareyama (JP); Manabu Inoue, Nagareyama (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 0 days.

(21) Appl. No.: 17/787,858

(22) PCT Filed: Nov. 5, 2020

(86) PCT No.: PCT/JP2020/041349
§ 371 (c)(1),
(2) Date: Jun. 21, 2022

(87) PCT Pub. No.: WO2021/131339
PCT Pub. Date: Jul. 1, 2021

(65) Prior Publication Data

US 2023/0041195 A1 Feb. 9, 2023

(30) Foreign Application Priority Data

Dec. 23, 2019 (JP) ..... 2019-231534

(51) Int. Cl.
*C25D 3/56* (2006.01)
*C25D 15/02* (2006.01)

(52) U.S. Cl.
CPC ..... *C25D 3/56* (2013.01); *C25D 15/02* (2013.01)

(58) Field of Classification Search
None
See application file for complete search history.

(56) References Cited

U.S. PATENT DOCUMENTS 3,766,024 A * 10/1973 Yamagishi ..... C25D 3/22 205/314
4,075,066 A 2/1978 Eckles et al.
(Continued)

FOREIGN PATENT DOCUMENTS

EP 2 357 269 A1 8/2011
JP S50-44195 A 4/1975
(Continued)

OTHER PUBLICATIONS

International Search Report issued in PCT Application No. PCT/JP2020/041349, mailed Dec. 15, 2020.
(Continued)

*Primary Examiner* — Louis J Rufo
(74) *Attorney, Agent, or Firm* — Foley & Lardner LLP

(57) ABSTRACT

The purpose of the present invention is to provide a zinc-nickel-silica composite plating bath that has been improved in terms of: covering power for articles having a complex shape; and corrosion resistance of a low current density portion where the film thickness is small. The present invention pertains to a zinc-nickel-silica composite plating bath, the plating bath having a pH of 3.5 to 6.9, and containing zinc ions, nickel ions, colloidal silica, and chloride ions. The colloidal silica is a cationic colloidal silica having on the surface thereon at least one species of metal cation selected from the group consisting of trivalent to heptavalent metal cations.

11 Claims, 1 Drawing Sheet

(56) References Cited

U.S. PATENT DOCUMENTS

| | | | | | |
|---|---|---|---|---|---|
| 4,804,587 | A * | 2/1989 | Takeuchi | C23C 28/00 | 428/629 |
| 4,985,311 | A * | 1/1991 | Shindou | C25D 5/12 | 205/171 |
| 2005/0189231 | A1* | 9/2005 | Capper | C25D 3/565 | 420/513 |
| 2006/0283715 | A1* | 12/2006 | Diaddario, Jr. | C25D 3/565 | 205/245 |
| 2008/0028976 | A1* | 2/2008 | Kubota | C25D 3/56 | 106/1.21 |
| 2009/0017225 | A1* | 1/2009 | Janssen | C25D 13/04 | 427/560 |
| 2016/0068984 | A1* | 3/2016 | Omachi | C25D 3/565 | 205/246 |
| 2019/0249323 | A1* | 8/2019 | Furukawa | C25D 5/36 | |

FOREIGN PATENT DOCUMENTS

| | | | | |
|---|---|---|---|---|
| JP | S5394227 | A | | 8/1978 | |
| JP | S54-159342 | A | | 12/1979 | |
| JP | S61-127900 | A | | 6/1986 | |
| JP | S61-130498 | A | | 6/1986 | |
| JP | S6254099 | A | * | 3/1987 | C25D 15/02 |
| JP | S63-11695 | A | | 1/1988 | |
| JP | S63-123807 | A | | 5/1988 | |
| JP | S63-199899 | A | | 8/1988 | |
| JP | H05-000475 | B2 | | 1/1993 | |
| JP | H718040 | B2 | | 1/1995 | |
| JP | H07-258895 | A | | 10/1995 | |
| JP | 2007-002274 | A | | 1/2007 | |
| JP | 2007-525598 | A | | 9/2007 | |
| JP | 5141908 | B2 | | 2/2013 | |
| JP | 5272275 | B2 | | 8/2013 | |
| JP | 5505620 | B2 | | 5/2014 | |
| JP | 2014-144908 | A | | 8/2014 | |
| JP | 2014-189850 | A | | 10/2014 | |

OTHER PUBLICATIONS

Extended European Search Report for EP Application No. 20905408.9 dated Dec. 1, 2023, 8 pages.

Sanyo Chemical Products & Technologies, "Surfactant Basics 4 (Dispersants)" retrieved from https://sanyo-chemical-solutions.com/technology/2024/04/102494/, 2024.

* cited by examiner

ZINC-NICKEL-SILICA COMPOSITE PLATING BATH AND METHOD FOR PLATING USING SAID PLATING BATH

CROSS REFERENCE TO RELATED APPLICATIONS

This application is a national stage entry of PCT Application No. PCT/JP2020/041349, filed on Nov. 5, 2020, which claims priority to Japanese Application No. 2019-231534, filed on Dec. 23, 2019, the contents of all of which are incorporated herein by reference in their entireties.

TECHNICAL FIELD

The present invention relates to a zinc-nickel-silica composite plating bath. It relates to a zinc-nickel-silica composite plating bath that has a favorable covering power and can be used particularly for shaped articles and shaped parts (hereinafter referred to as shaped articles, including shaped parts) as a general surface treatment for corrosion prevention, and a plating method using the bath.

BACKGROUND ART

It is well known that zinc-nickel alloy plating has an excellent corrosion resistance. Zinc and nickel, which are raw materials of the zinc-nickel alloy plating, are rare metals, the natural resources of which are limited, and also nickel is expensive. For these reasons, there is a demand for the development of zinc-nickel alloy plating that can achieve a high corrosion resistance even when the plating film thickness is reduced. In other words, there is a demand for cost reduction and saving of natural resources by reducing the amounts of zinc and nickel, which are the raw materials, to be used. As a method for solving the problem, for electroplated steel plates, a high-speed, acidic zinc-nickel-silica composite plating method with a sulfuric acid bath whose pH is adjusted to 2, using general acidic colloidal silica has been studied (Non-Patent Literature 1). However, this method has a drawback that not only the pH of the sulfuric acid bath is low, but also the covering power is very poor due to the sulfuric acid bath, and this method is not suitable for plating of shaped articles. On the other hand, there is a tendency that the covering power is improved by increasing the pH of the plating bath. However, since the use of general acidic colloidal silica causes aggregation in the plating bath, it has been necessary to reduce the pH of the plating bath, so that the pH of the plating bath cannot be increased.

In the meantime, Non-Patent Literature 2 discloses that when a commercially-available colloidal silica.acidic silica sol aqueous solution (SNOWTEX-O produced by Nissan Chemical Industries, Ltd.) is added to a zinc-nickel plating bath, nickel ions are preferentially adsorbed into the negatively charged colloidal silica in the bath, and the colloidal silica which has adsorbed the nickel ions acts as a cation to initiate electrolysis and migrate toward the cathode, so that the silica is taken in a film. Although the red rust resistance is improved by this codeposition of silica, the white rust resistance is insufficient. For this reason, an amine-based silane coupling treatment is conducted on the surface of the zinc-nickel-silica composite plating film.

CITATION LIST

Non-Patent Literature

Non-Patent Literature 1: Journal of the Japan Institute of Metals Vol. 78, No. 1 (2014) 31-36

Non-Patent Literature 2: Journal of the Surface Finishing Society of Japan Vol. 57, No. 12, p 860-p 865 (2006)

SUMMARY OF INVENTION

Problems to be Solved by the Invention

The object of the present invention is to provide a zinc-nickel-silica composite plating bath that achieves both an improved covering power for an article having a complicated shape and an improved corrosion resistance for a low current density portion having a thin film thickness.

In addition, the object of the present invention is to provide a zinc-nickel-silica composite plating method that achieves both an improved covering power for an article having a complicated shape and an improved corrosion resistance for a low current density portion having a thin film thickness.

Means for Solution of the Problems

The present invention was made based on a finding that the above problem can be solved by using a cationic colloidal silica having at least one selected from the group of trivalent to heptavalent metal cations on a surface thereof as a colloidal silica, and using a specific plating bath within an intermediate acidic range.

Specifically, the present invention has the following aspects.

1. A zinc-nickel-silica composite plating bath, wherein the plating bath has a pH of 3.5 to 6.9 and comprises zinc ions, nickel ions, colloidal silica, and chloride ions, and the colloidal silica is a cationic colloidal silica having at least one selected from the group of trivalent to heptavalent metal cations on a surface thereof.
2. The zinc-nickel-silica composite plating bath according to the above 1, wherein the colloidal silica is a cationic colloidal silica having at least one metal cation selected from a trivalent iron cation, a trivalent aluminum cation, a trivalent titanium cation, a tetravalent zirconium cation, a tetravalent vanadium cation, and a pentavalent antimony cation on the surface thereof.
3. The zinc-nickel-silica composite plating bath according to the above 1 or 2, wherein the plating bath has a pH of 4.5 to 6.0.
4. The zinc-nickel-silica composite plating bath according to any one of the above 1 to 3, comprising an amine-based chelating agent.
5. The zinc-nickel-silica composite plating bath according to any one of the above 1 to 4, comprising a sulfonic acid salt obtained by adding ethylene oxide or propylene oxide or a block copolymer of ethylene oxide and propylene oxide to naphthol or cumylphenol.
6. The zinc-nickel-silica composite plating bath according to any one of the above 1 to 5, comprising an aromatic carboxylic acid and/or a salt thereof.
7. The zinc-nickel-silica composite plating bath according to the above 6, wherein the aromatic carboxylic acid and/or the salt thereof is benzoic acid, a benzoate salt, or a combination of these.
8. The zinc-nickel-silica composite plating bath according to any one of the above 1 to 7, comprising an aromatic aldehyde and/or an aromatic ketone.
9. The zinc-nickel-silica composite plating bath according to the above 8, wherein the aromatic aldehyde and the aromatic ketone are o-chlorobenzaldehyde and benzalacetone, respectively.

10. The zinc-nickel-silica composite plating bath according to any one of the above 1 to 9, comprising at least one or more buffering agents selected from the group consisting of ammonia, an ammonium salt, acetic acid, an acetate salt, boric acid, and a borate salt.
11. The zinc-nickel-silica composite plating bath according to any one of the above 1 to 10, comprising no sulfate ions.
12. A plating method comprising:

applying zinc-nickel-silica composite plating to a plating target by using the plating target as a cathode, using zinc and nickel as an anode, and using the zinc-nickel-silica composite plating bath according to any one of the above 1 to 11.

13. The plating method comprising:

applying zinc-nickel-silica composite plating to a plating target by using the plating target as a cathode, using zinc, nickel, or both of these as an anode, placing part or all of the zinc anode in an anode chamber partitioned with an ion-exchange membrane, and using the zinc-nickel-silica composite plating bath according to any one of the above 1 to 11.

Advantageous Effects of Invention

The plating bath of the present invention has a favorable covering power even for a shaped article and achieves a high corrosion resistance even with a thin film thickness, and thus can be used in a wide variety of usages such as parts for automobiles, parts for home electrical appliances, and the like with reduced natural resources at low cost.

In addition, while the thickness of a plating film of zinc-nickel-silica composite electroplating is normally 5 μm or more, the present invention has an advantage that even when the plating film thickness is reduced to around 2 to 3 it is possible to achieve a high corrosion resistance. In addition, for articles that can be well covered as well, the present invention has an advantage that even when the film thickness is reduced compared to that of the conventional zinc-nickel alloy plating, it is possible to achieve a high corrosion resistance by using silica.

DESCRIPTION OF EMBODIMENTS

Figure 1:
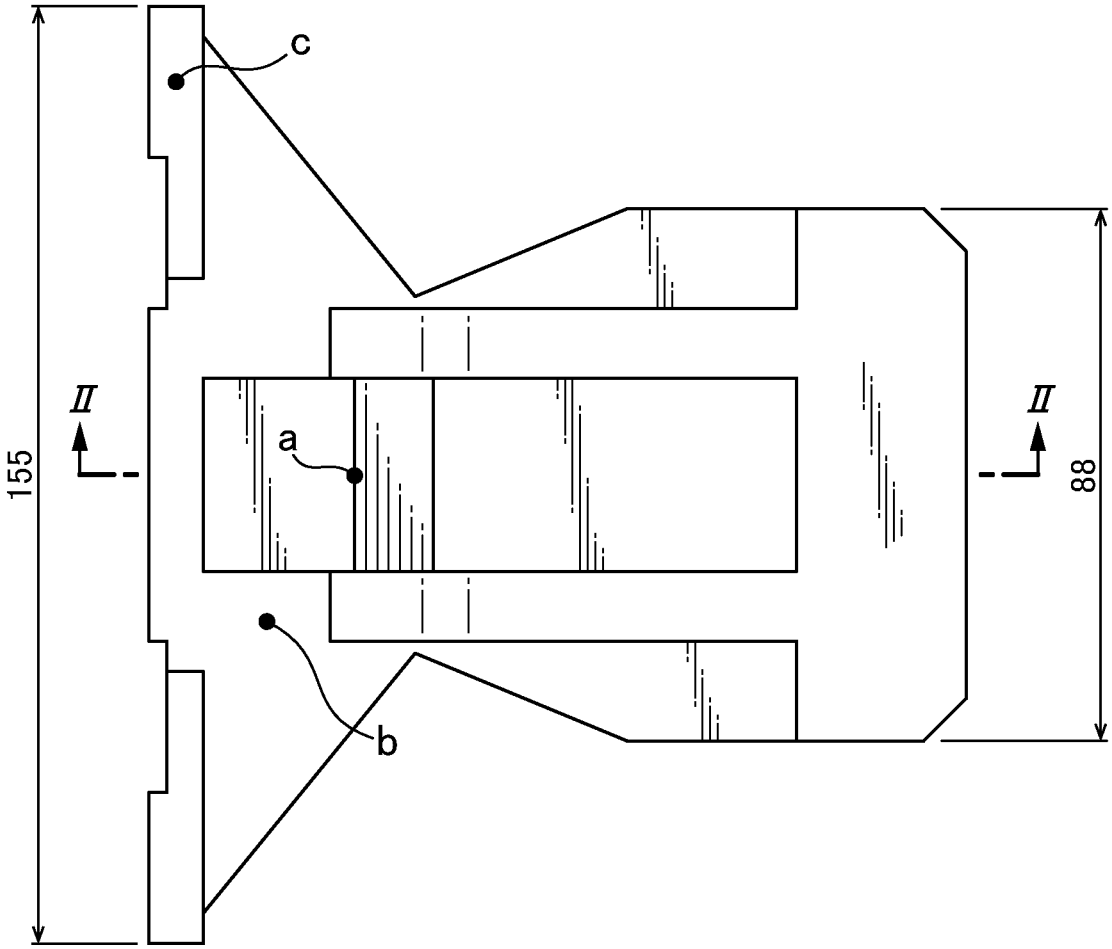
FIG. 1 is a front view of a brake caliper used in Examples and Comparative Examples for forming zinc-nickel-silica composite plating films on a surface thereof.
Figure 2:
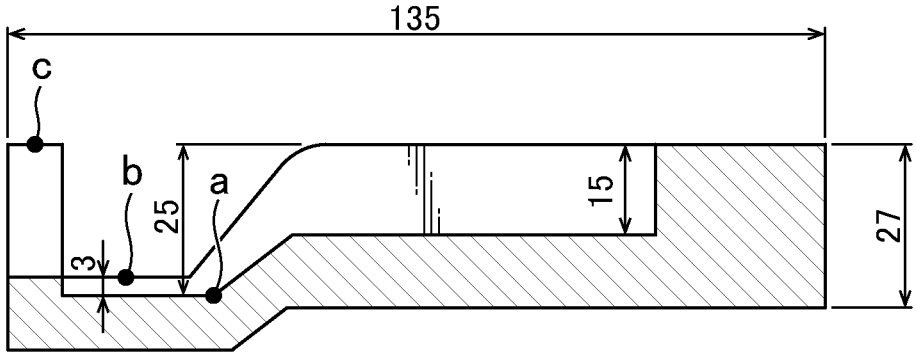
FIG. 2 is a cross-sectional view taken along the line II-II in FIG. 1.

A zinc-nickel-silica composite electroplating bath of the present invention uses an acidic plating bath having a pH of 3.5 to 6.9 in order to improve a covering power. Particularly, a chloride bath is most preferable. In addition, the pH of the plating bath is preferably 4.5 to 6.0, and most preferably 5.2 to 5.8. Note that the pH of the plating bath can be easily adjusted using hydrochloric acid, a sodium hydroxide aqueous solution, a potassium hydroxide aqueous solution, ammonia water, a sodium carbonate aqueous solution, a potassium carbonate aqueous solution, acetic acid, a sodium acetate aqueous solution, a potassium acetate aqueous solution, or the like.

The composite plating bath of the present invention comprises zinc ions, nickel ions, colloidal silica, and chloride ions (Cl—) as essential components.

The zinc ions are derived from a water-soluble zinc salt. As the water-soluble zinc salt, zinc chloride is preferable. The concentration thereof is preferably 40 to 130 g/L, and further preferably, 60 to 110 g/L.

The nickel ions are derived from a water-soluble nickel salt. As the water-soluble nickel salt, nickel chloride is preferable. The concentration thereof is preferably 70 to 150 g/L, and further preferably 75 to 120 g/L, in terms of nickel chloride 6-hydrate.

The chloride ions are derived from the above zinc chloride and nickel chloride, but are also derived from a water-soluble chloride other than those added to the plating bath. The amount of the chloride ions is a total amount of chloride ions derived from water-soluble chlorides in the plating bath. The concentration thereof is preferably 100 to 300 g/L, and further preferably 120 to 240 g/L.

The colloidal silica used in the present invention is a colloidal silica whose zeta potential is cationic and which has at least one selected from the group of trivalent to heptavalent metal cations on a surface thereof. The particle size (BET) thereof is preferably nano-size and a particle size of 5 nm to 100 nm is suitable. The particle size is further preferably 10 nm to 65 nm. The concentration thereof for use is 1 to 100 g/L, and preferably 10 to 80 g/L.

Here, examples of at least one selected from the group of trivalent to heptavalent metal cations include trivalent iron, aluminum, titanium, niobium, molybdenum, tantalum, manganese, indium, antimony, bismuth, scandium, gallium, and cobalt, tetravalent zirconium, vanadium, tungsten, titanium, niobium, molybdenum, tantalum, manganese, tin, and tellurium, pentavalent antimony, tungsten, niobium, molybdenum, tantalum, and bismuth, hexavalent tungsten, molybdenum, manganese, and tellurium, and heptavalent manganese. Among these, at least one selected from the group consisting of trivalent, tetravalent, and pentavalent metal cations is preferable, trivalent iron, trivalent aluminum, trivalent titanium, tetravalent zirconium, tetravalent vanadium, pentavalent antimony, and the like are preferable, and aluminum is particularly preferable.

The colloidal silica having a specific metal cation on a surface thereof includes, for example, colloidal silica particles comprising a polyvalent metal element M in an average content of 0.001 to 0.02 in terms of an M/Si molar ratio, and having an average primary particle size of 5 to 40 nm, wherein the amount of the polyvalent metal element M present in an outermost layer of the colloidal particles is 0 to 0.003 per $nm^2$ of a surface area of the colloidal particles, described in Japanese Patent Publication No. 2014-144908 and Japanese Patent No. 5505620. Such a colloidal silica can be produced, for example, by a production method described in [0064] to [0067] of Japanese Patent Publication No. 2014-144908. In addition, such a colloidal silica can be produced by methods described in Japanese Patent Publication No. S63-123807 and Japanese Patent Application Publication No. S50-44195. As raw materials for producing at least one selected from the group of trivalent to heptavalent metal cations, for example, basic salts, oxides, hydroxides, hydrated metal oxides, and the like of these metals can be used.

Furthermore, a silica-alumina composite sol containing composite colloidal particles in which colloidal silica particles covered with fine colloidal alumina hydrate particles and colloidal alumina hydrate particles having a major axis 10 times or more a primary particle size of the colloidal silica particles and a minor axis of 2 to 10 nm, which is described in Japanese Patent No. 5141908, can also be used.

The descriptions of Japanese Patent Publication No. 2014-144908, Japanese Patent No. 5505620, Japanese Patent Publication No. S63-123807, Japanese Patent Publication No. S50-44195, and Japanese Patent No. 5141908 are incorporated in the description of the present specification.

The colloidal silica having a specific metal cation on a surface thereof used in the present invention can be easily obtained from the market, which include, for example, AK-type colloidal silica (SNOWTEX ST-AK), (SNOWTEX ST-AK-L), and (SNOWTEX ST-AK-YL) produced by Nissan Chemical Corporation.

The composite plating bath of the present invention may contain one or more electrically conductive salts. By using an electrically conductive salt, it is possible to reduce voltage while applying current and thus improve the current efficiency. The electrically conductive salt to be used in the present invention includes, for example, chlorides, sulfates, carbonates, and the like. Among these, at least one or more chloride of potassium chloride, ammonium chloride, and sodium chloride is preferably used.

Particularly, use of one of potassium chloride and ammonium chloride alone, or these in combination is preferable. In the case where potassium chloride is used alone, the concentration of potassium chloride is preferably 150 to 250 g/L, and in the case where ammonium chloride is used alone, the concentration of the ammonium chloride is preferably 150 to 300 g/L. In the case where potassium chloride and ammonium chloride are used in combination, the concentration of potassium chloride is preferably 70 to 200 g/L, and the concentration of ammonium chloride is preferably 15 to 150 g/L. Ammonium chloride also has an effect as a buffering agent. In the case where ammonium chloride is not used, ammonia, an ammonium salt, boric acid, or a borate salt, acetic acid, or an acetate salt such as potassium acetate or sodium acetate is preferably used as a buffering agent. The total concentration of boric acid and/or a borate salt is preferably 15 to 90 g/L. The total concentration of acetic acid and/or an acetate salt is preferably 5 to 140 g/L, more preferably 7 to 140 g/L, and further preferably 8 to 120 g/L.

In order to further improve the covering power of the plating film and to densify the film, the composite plating bath of the present invention preferably contains a sulfonic acid salt obtained by adding ethylene oxide or/and propylene oxide to naphthol or cumylphenol in a total amount of 3 to 65 mol, and preferably 8 to 62 mol, and an aromatic carboxylic acid having 7 to 15 carbon atoms and a derivative thereof and salts of these, alone or in combination. The naphthol is particularly preferably β-naphthol. The sulfonic acid salt includes potassium salt, sodium salt, amine salt, and the like. Specifically, the sulfonic acid salt includes [(3-sulfopropoxy)-polyethoxy-polyisopropoxy]-beta-naphtylether]potassium salt (the total number of moles of EO and/or PO added is 3 to 65 mol, and preferably 8 to 62 mol), polyoxyethylene p-cumylphenylether sulfuric acid ester sodium salt (the number of moles of EO added is 3 to 65 mol, and preferably 8 to 62 mol), and the like.

The concentration of the sulfonic acid salt obtained by adding ethylene oxide or/and propylene oxide to naphthol or cumylphenol in the plating bath is preferably 0.1 to 10 g/L, and further preferably 0.2 to 5 g/L. The aromatic carboxylic acid and a derivative thereof and salts of these include, for example, benzoic acid, sodium benzoate, terephthalic acid, sodium terephthalate, ethyl benzoate, and the like. It is preferable that the concentration thereof be preferably 0.5 to 5 g/L, and further preferably 1 to 3 g/L.

These naphthol-based anionic surfactants can be easily obtained from the market, which include, for example, RALUFON NAPE 14-90 (the total number of moles of EO, PO added is 17) produced by Raschig, and SUNLEX BNS (EO: 27 mol) and SUNLEX BNS6 (EO: 6 mol) produced by Nicca Chemical Co., Ltd.

In addition, the cumylphenol-based anionic surfactants can be easily obtained from the market, which include, for example, Newcol CMP-4-SN (the number of moles of EO added is 4 mol), CMP-11-SN (the number of moles of EO added is 11 mol), CMP-40-SN (the number of moles of EO added is 40 mol), and CMP-60-SN (the number of moles of EO added is 60 mol), produced by Nippon Nyukazai Co., Ltd.

Moreover, in order to allow nickel to uniformly precipitate independently from the current density, the composite plating bath of the present invention preferably contains an amine-based chelating agent. The amine-based chelating agent includes, for example, alkylene amine compounds such as ethylenediamine, diethylenetriamine, triethylenetetramine, and tetraethylenepentamine, ethylene oxide adducts and propylene oxide adducts of the alkylene amines; amino alcohols such as N-(2-aminoethyl)ethanolamine, 2-hydroxyethylamino propylamine; poly(hydroxyalkyl)alkylenediamines such as N-2(-hydroxyethyl)-N,N',N'-triethylethylenediamine, N,N'-di(2-hydroxyethyl)-N,N'-diethylethylenediamine, N,N,N',N'-tetrakis(2-hydroxyethyl) propylenediamine, and N,N,N',N'-tetrakis(2-hydroxypropyl)ethylenediamine; poly(alkylene imines) obtained from ethyleneimine, 1,2-propyleneimine, and the like, poly(alkylene amines) or poly(amino alcohols) obtained from ethylenediamine, triethylenetetramine, ethanolamine, diethanolamine, and the like. Among these, an alkylene amine compound having 1 to 12 carbon atoms (preferably, 2 to 10 carbon atoms) and 2 to 7 nitrogen atoms (preferably, 2 to 6 nitrogen atoms), and an ethylene oxide adduct and a propylene oxide adduct thereof are preferable. One of these amine-based chelating agents may be used alone, or two or more of these may be used in combination. The concentration of the amine-based chelating agent in the plating bath is preferably 0.5 to 50 g/L, and further preferably 1 to 5 g/L.

Note that causing the composite plating bath of the present invention to contain an amine-based chelating agent has an advantage that it is possible to achieve a high codeposition rate of nickel by adjusting the codeposition rate of nickel.

In a case where densification and gloss of the composite film are necessary, the composite plating bath of the present invention preferably contains an aromatic aldehyde having 7 to 10 carbon atoms or an aromatic ketone having 8 to 14 carbon atoms. The aromatic aldehyde includes, for example, o-carboxybenzaldehyde, benzaldehyde, o-chlorobenzaldehyde, p-tolualdehyde, anisaldehyde, p-dimethylaminobenzaldehyde, terephthalaldehyde, and the like. The aromatic ketone includes, for example, benzalacetone, benzophenone, acetophenone, terephthaloyl benzyl chloride, and the like. Here, particularly preferable compounds are benzalacetone and o-chlorobenzaldehyde. The concentration of each in the bath is preferably 0.1 to 20 mg/L, and more preferably 0.3 to 10 mg/L.

The balance of the composite plating bath of the present invention is water.

Note that in the composite plating bath of the present invention, since the components in the plating bath are stabilized by the action of the cationic colloidal silica having at least one selected from the group of trivalent to heptavalent metal cations on a surface thereof, a dispersant does not have to be used.

As the plating method using the zinc-nickel-silica composite plating bath of the present invention, electroplating is used. The electroplating can be conducted with a direct current or a pulsed current.

The bath temperature is normally within a range of 25 to 50° C., and preferably within a range of 30 to 45° C. The electroplating is favorably conducted under an electrolysis condition that the current density is normally within a range of 0.1 to 15 A/dm$^2$, and preferably within a range of 0.5 to 10 A/dm$^2$. In addition, in the case of conducting the plating, it is preferable to agitate the liquid with air blow or jet blast. In this way, the current density can be further enhanced.

As the anode, one of a zinc plate, a nickel plate, a zinc ball, a nickel chip, and the like, or a combination of these is desirable.

As the cathode, a metal article to which the zinc-nickel-silica composite plating film of the present invention is applied is used. As this metal article, electrically conductive articles of various metals such as iron, nickel, and copper and alloys of these, or metals such as aluminum and alloys subjected to a zinc substitution process are used. As to the shape, any articles such as plate-shaped articles such as plates and shaped articles having complicated appearances can be used. In the present invention, particularly since the covering power of the plating film is favorable, the plating film can be applied to shaped articles including fastening parts such as bolts and nuts and various cast parts such as brake calipers.

In the present invention, further, the zinc-nickel-silica composite plating can be applied to a plating target using the plating target as the cathode, using zinc and nickel as the anode, placing part or all of the zinc anode in an anode chamber partitioned with an ion-exchange membrane, and using the zinc-nickel-silica composite plating bath. This method has an advantage that since an increase in concentrations of metals (particularly, the concentration of zinc) in the plating liquid associated with the operation can be suppressed and controlled, a plating film with a stable quality can be obtained.

The codeposition rate of nickel in the zinc-nickel-silica composite plating film obtained by using the zinc-nickel-silica composite electroplating bath of the present invention is preferably 5 to 18% by weight, more preferably 10 to 18% by weight, and most preferably 12 to 15% by weight. The content of $SiO_2$ is preferably 0.3 to 5% by weight, and further preferably 1.5 to 4% by weight. Setting the codeposition rate of nickel and the content of $SiO_2$ as described above makes the corrosion resistance of the plating film favorable. Note that it is preferable that the balance be zinc.

Next, the present invention will be described in further detail based on Examples; however, the present invention is not limited to these Examples at all.

EXAMPLES

Example 1

First, 73 g/L of zinc chloride (35 g/L as the concentration of zinc), 89 g/L of nickel chloride 6-hydrate (22 g/L as the concentration of nickel), 160 g/L of potassium chloride (the concentration of all the chlorines was 140 g/L), 2.5 g/L of diethylenetriamine, 1.5 g/L of sodium benzoate, 105 g/L of potassium acetate, 4 g/L of [(3-sulfopropoxy)-polyethoxy-polyisopropoxy]-beta-naphtylether]potassium salt (the total number of moles of EO and PO added was 17 mol, the same applies hereinafter), and 6 mg/L of benzalacetone were mixed and dissolved in water, and the mixture was adjusted to a pH of 5.4 using hydrochloric acid to prepare a plating bath (350 liter).

Into the bath, 50 g/L of a cationic colloidal silica (SNOW-TEX ST-AK) having a particle size of 12 nm (BET) and having $Al^{3+}$ on a surface thereof was mixed and dissolved by agitating. In this event, aggregation of the bath components did not occur.

Next, a brake caliper illustrated in FIG. 1 was subjected to a pretreatment including the steps of alkaline degreasing, water washing, acid washing, water washing, alkaline electrolytic cleaning, water washing, hydrochloric acid activation, and water washing, and this brake caliper was used as the cathode. A zinc plate and a nickel plate were used as the anode, and plating was conducted at a bath temperature of 35° C. with a direct-current power supply with a cathode current density of 2 A/dm$^2$ for 38 minutes. Note that the plating bath was subjected to air bubbling (the amount of air: about 2,400 liter/min).

Note that the size of the brake caliper illustrated in FIG. 1 was as indicated by numbers (mm) in the drawing. The zinc plate was a plate having a length of 800 mm, a width of 100 mm, and a thickness of 20 mm, and the nickel plate was a plate having a length of 700 mm, a width of 150 mm, and a thickness of 15 mm.

In this example, the codeposition rate of nickel (%), the content of $SiO_2$ (%), the film thickness distribution, the corrosion resistance, and the like of the zinc-nickel-silica composite plating film were evaluated in accordance with the following methods. The evaluation results are shown in Table 1.

(Method for Measuring Decomposition Rate of Ni (%) and Thickness)

The codeposition rate of nickel (%) and the thickness of the plating film were measured using an X-ray fluorescence spectrometer (Micro Element Monitor SEA5120 manufactured by SII NanoTechnology Inc.).

(Content of $SiO_2$ (%))

The analysis was conducted using an electron microscope SEM-EDS manufactured by JEOL Ltd.

(Method for Measuring Time of Generation of Red Rust in SST)

The time of generation of red rust in SST was judged for an observed portion in accordance with the methods of salt spray testing (JIS Z2371). Specifically, the time of generation of red rust was visually checked in accordance with the neutral salt splay test (NSS).

Example 2

First, 73 g/L of zinc chloride (35 g/L as the concentration of zinc), 89 g/L of nickel chloride 6-hydrate (22 g/L as the concentration of nickel), 160 g/L of potassium chloride (the concentration of all the chlorines was 140 g/L), 2.5 g/L of diethylenetriamine, 1.5 g/L of sodium benzoate, 105 g/L of potassium acetate, 4 g/L of [(3-sulfopropoxy)-polyethoxy-polyisopropoxy]-beta-naphtylether]potassium salt, and 6 mg/L of benzalacetone were mixed and dissolved in water, and the mixture was adjusted to a pH of 5.4 in the same manner as in Example 1 to prepare a plating bath.

Into the bath, 50 g/L of a cationic colloidal silica (SNOW-TEX ST-AK-L) having a particle size of 45 nm (BET) and having $Al^3$ on a surface thereof was mixed and dissolved by agitating. In this event, aggregation of the bath components did not occur.

Next, plating was conducted using the same cathode and anode as in Example 1 under the same conditions as in Example 1. The codeposition rate of nickel (%), the content of $SiO_2$ (%), the film thickness distribution, the corrosion resistance, and the like of the zinc-nickel-silica composite plating film thus obtained were evaluated in the same manner as in Example 1, and the evaluation results are shown in Table 1.

Example 3

First, 73 g/L of zinc chloride (35 g/L as the concentration of zinc), 89 g/L of nickel chloride 6-hydrate (22 g/L as the concentration of nickel), 160 g/L of potassium chloride (the concentration of all the chlorines was 140 g/L), 2.5 g/L of diethylenetriamine, 1.5 g/L of sodium benzoate, 105 g/L of potassium acetate, 4 g/L of [(3-sulfopropoxy)-polyethoxy-polyisopropoxy]-beta-naphtylether]potassium salt, and 0.5 mg/L of o-chlorobenzaldehyde were mixed and dissolved in water, and the mixture was adjusted to a pH of 5.4 in the same manner as in Example 1 to prepare a plating bath.

Into the bath, 50 g/L of a cationic colloidal silica (SNOWTEX ST-AK-YL) having a particle size of 60 nm (BET) and having $Al^{3+}$ on a surface thereof was mixed and dissolved by agitating. In this event, aggregation of the bath components did not occur.

Next, plating was conducted using the same cathode and anode as in Example 1 under the same conditions as in Example 1. The codeposition rate of nickel (%), the content of $SiO_2$ (%), the film thickness distribution, the corrosion resistance, and the like of the zinc-nickel-silica composite plating film thus obtained were evaluated in the same manner as in Example 1, and the evaluation results are shown in Table 1.

Example 4

First, 94 g/L of zinc chloride (45 g/L as the concentration of zinc), 89 g/L of nickel chloride 6-hydrate (22 g/L as the concentration of nickel), 165 g/L of potassium chloride, 100 g/L of ammonium chloride (the concentration of all the chlorines was 220 g/L), 2.5 g/L of diethylenetriamine, 1.5 g/L of sodium benzoate, 19 g/L of potassium acetate, 2 g/L of polyoxyethylene p-cumylphenylether sulfuric acid ester sodium salt (the number of moles of EO added was 11 mol: Newcol CMP-11-SN produced by Nippon Nyukazai Co., Ltd.), and 6 mg/L of benzalacetone were mixed and dissolved in water, and the mixture was adjusted to a pH of 5.6 in the same manner as in Example 1 to prepare a plating bath.

Into the bath, 50 g/L of a cationic colloidal silica (SNOWTEX ST-AK) having a particle size of 12 nm (BET) and having $Al^{3+}$ on a surface thereof was mixed and dissolved by agitating. In this event, aggregation of the bath components did not occur.

Next, plating was conducted using the same cathode and anode as in Example 1 under the same conditions as in Example 1 except for plating conditions of a cathode current density of 5 A/dm$^2$ and 15 minutes. The codeposition rate of nickel (%), the content of $SiO_2$ (%), the film thickness distribution, the corrosion resistance, and the like of the zinc-nickel-silica composite plating film thus obtained were evaluated in the same manner as in Example 1, and the evaluation results are shown in Table 1.

Comparative Example 1

First, 73 g/L of zinc chloride (35 g/L as the concentration of zinc), 89 g/L of nickel chloride 6-hydrate (22 g/L as the concentration of nickel), 160 g/L of potassium chloride (the concentration of all the chlorines was 140 g/L), 2.5 g/L of diethylenetriamine, 1.5 g/L of sodium benzoate, 105 g/L of potassium acetate, 4 g/L of [(3-sulfopropoxy)-polyethoxy-polyisopropoxy]-beta-naphtylether]potassium salt, and 6 mg/L of benzalacetone were mixed and dissolved in water, and the mixture was adjusted to a pH of 5.4 in the same manner as in Example 1 to prepare a plating bath.

Next, plating was conducted using the same cathode and anode as in Example 1 under the same conditions as in Example 1. The codeposition rate of nickel (%), the content of $SiO_2$ (%), the film thickness distribution, the corrosion resistance, and the like of the zinc-nickel-silica composite plating film thus obtained were evaluated in the same manner as in Example 1, and the evaluation results are shown in Table 1.

Comparative Example 2

First, 73 g/L of zinc chloride (35 g/L as the concentration of zinc), 89 g/L of nickel chloride 6-hydrate (22 g/L as the concentration of nickel), 160 g/L of potassium chloride (the concentration of all the chlorines was 140 g/L), 2.5 g/L of diethylenetriamine, 1.5 g/L of sodium benzoate, 105 g/L of potassium acetate, 4 g/L of [(3-sulfopropoxy)-polyethoxy-polyisopropoxy]-beta-naphtylether]potassium salt, and 6 mg/L of benzalacetone were mixed and dissolved in water, and the mixture was adjusted to a pH of 5.4 in the same manner as in Example 1 to prepare a plating bath.

Into the bath, 50 g/L of an anionic colloidal silica (SNOWTEX ST-O) having a particle size of 12 nm (BET) was added and mixed by agitating. However, the colloidal silica was aggregated and was not dissolved in the bath. Hence, the plating test was not conducted. The results of this Comparative Example are shown in Table 1.

Comparative Example 3

First, 86.3 g/L of zinc sulfate 7 hydrate (19.6 g/L as the concentration of zinc), 184 g/L of nickel sulfate 6 hydrate (41.1 g/L as the concentration of nickel), and 71 g/L of sodium sulfate were mixed and dissolved in water, and the mixture was adjusted to a pH of 2.0 using sulfuric acid to prepare a plating bath (350 liter).

Into the bath, 50 g/L of an anionic colloidal silica (SNOWTEX ST-O) having a particle size of 12 nm (BET) was added, mixed by agitating, and dissolved. In this event, aggregation of the bath components did not occur.

Next, plating was conducted using the same cathode and anode as in Example 1 at a bath temperature of 50° C. with a direct-current power supply with a cathode current density of 2 A/dm$^2$ for 38 minutes (Comparative Example 3-1). Note that the plating bath was subjected to air bubbling in the same manner as in Example 1.

Furthermore, the plating time was extended such that the film thickness of a film thickness measured portion c became around 18 μm similar to Examples (plating for 57 minutes: Comparative Example 3-2).

In Comparative Examples 3-1 and 3-2, the codeposition rate of nickel (%), the content of $SiO_2$ (%), the film thickness distribution, the corrosion resistance, and the like of each zinc-nickel-silica composite plating film were measured in the same manner as in Example 1. The evaluation results are shown in Table 1.

TABLE 1

The results of measuring the codeposition rate of nickel (%), the content of $SiO_2$ (%), the film thickness distribution, the corrosion resistance, and the like of each zinc-nickel-silica composite plating film

| | Measurement position | Film thickness (μm) | Codeposition rate of nickel (%) | Content of $SiO_2$ (%) | Time of generation of red rust (h) | Stability of the colloidal silica in the liquid |
|---|---|---|---|---|---|---|
| Example 1 | a | 3.1 | 14.2 | 2.0 | 720 | Dissolved, Stable |
| | b | 14.3 | 14.6 | 2.2 | 1000 | |
| | c | 18.5 | 14.5 | 2.1 | 1500 | |
| Example 2 | a | 3.0 | 14.2 | 1.8 | 720 | Dissolved, Stable |
| | b | 14.7 | 14.4 | 2.0 | 1000 | |
| | c | 19.1 | 14.5 | 2.1 | 1500 | |
| Example 3 | a | 3.0 | 14.2 | 2.1 | 720 | Dissolved, Stable |
| | b | 14.3 | 14.2 | 2.3 | 1000 | |
| | c | 18.4 | 14.6 | 2.1 | 1500 | |
| Example 4 | a | 3.2 | 14.2 | 2.1 | 720 | Dissolved, Stable |
| | b | 14.8 | 14.1 | 2.4 | 1000 | |
| | c | 18.8 | 14.5 | 2.0 | 1500 | |
| Comparative Example 1 | a | 3.2 | 14.2 | 0 | 360 | — |
| | b | 14.3 | 14.6 | 0 | 720 | |
| | c | 18.5 | 14.5 | 0 | 1000 | |
| Comparative Example 2 | | — | — | — | — | Aggregated, Unstable |
| Comparative Example 3-1 | a | 0.5 | 12.2 | 1.8 | <24 | Dissolved, Stable |
| | b | 9.6 | 11.1 | 1.9 | 360 | |
| | c | 13.3 | 10.3 | 2.1 | 720 | |
| Comparative Example 3-2 | a | 0.8 | 12.4 | 1.9 | <48 | Dissolved, Stable |
| | b | 14.1 | 11.5 | 2.0 | 1000 | |
| | c | 17.5 | 10.9 | 2.1 | 1500 | |

As is clear from the results shown in Table 1, it is understood that according to the present invention, it is possible to make the thickness of the plating film at a recess portion a of a shaped article 3 μm or more and to thus form a zinc-nickel-silica composite electroplating having a favorable covering power (Examples) by plating with a cathode current density of 2 A/dm$^2$ for 38 minutes (Examples 1 to 3) and plating with a cathode current density of 5 A/dm$^2$ for 15 minutes (Example 4). Furthermore, it is also understood that when the pH of the plating bath is set within a range of 3.5 to 6.9, particularly within a range of pH 4.5 to 6.0, a cationic colloidal silica having at least one selected from the group of trivalent to heptavalent metal cations on a surface thereof is stably dissolved without precipitating in the plating liquid, thus making it possible to form a zinc-nickel-silica composite electroplating film having a high corrosion resistance, that is, a time of generation of red rust (h) of 720 hours or more.

On the other hand, in Comparative Example 1 which did not contain a colloidal silica, the time of generation of red rust (h) at the recess portion a was 360 hours, which was lower than 720 hours. Note that since Comparative Example 1 was a chloride bath, a film thickness of 3 μm or more was formed at the recess portion a; however, the corrosion resistance deteriorated overall without making up with a silica component, and was not able to be maintained for 720 hours or more at the recess portion a.

In addition, in Comparative Example 2 which used an anionic colloidal silica (SNOWTEX ST-O) not having at least one selected from the group of trivalent to heptavalent metal cations on the surface thereof, although the plating bath was sufficiently mixed by agitating, the colloidal silica was aggregated and was not dissolved in the bath, so that the plating test was not able to be conducted.

In contrast, in Comparative Example 3 which used a sulfuric acid plating bath having a pH of 2.0, different from the chloride bath having a pH of 5.4 used in Comparative Example 2, the anionic colloidal silica (SNOWTEX ST-O) was stably dissolved in the sulfuric acid plating bath with no colloidal silica precipitated. However, in the plating with a cathode current density of 2 A/dm$^2$ for 38 minutes, which was the same as in Examples 1 to 3, the plating film at the recess portion a of the shaped article had a significantly thin thickness of 0.5 the covering power was poor, and the time of generation of red rust (h) was less than 24 hours, so that a zinc-nickel-silica composite electroplating film having a high corrosion resistance was not able to be formed (Comparative Example 3-1).

Furthermore, when the plating time was extended (plating for 57 minutes: Comparative Example 3-2), although the film thickness at the film thickness measured portion c became as thick as 17.5 μm, the plating film at the recess portion a of the shaped article had a significantly thin thickness of 0.8 μm, the covering power was poor, and the time of generation of red rust (h) was less than 48 hours, so that a zinc-nickel-silica composite electroplating film having a high corrosion resistance was not able to be formed (Comparative Example 3-2).

What is claimed is:

1. A zinc-nickel-silica composite plating bath comprising a sulfonic acid salt obtained by adding ethylene oxide or propylene oxide or a block copolymer of ethylene oxide and propylene oxide to naphthol or cumylphenol, wherein the plating bath has a pH of 4.5 to 6.9 and comprises zinc ions, nickel ions, colloidal silica, and chloride ions, and the colloidal silica is a cationic colloidal silica having a trivalent aluminum cation on a surface thereof.

2. The zinc-nickel-silica composite plating bath according to claim 1, wherein the plating bath has a pH of 4.5 to 6.0.

3. The zinc-nickel-silica composite plating bath according to claim 1, comprising an amine-based chelating agent.

4. The zinc-nickel-silica composite plating bath according to claim 1, comprising an aromatic carboxylic acid and/or a salt thereof.

5. The zinc-nickel-silica composite plating bath according to claim 4, wherein the aromatic carboxylic acid and/or the salt thereof is benzoic acid, a benzoate salt, or a combination of these.

6. The zinc-nickel-silica composite plating bath according to claim 1, comprising an aromatic aldehyde and/or an aromatic ketone.

7. The zinc-nickel-silica composite plating bath according to claim 6, wherein the aromatic aldehyde and the aromatic ketone are o-chlorobenzaldehyde and benzalacetone, respectively.

8. The zinc-nickel-silica composite plating bath according to claim 1, comprising at least one or more buffering agents selected from the group consisting of ammonia, an ammonium salt, acetic acid, an acetate salt, boric acid, and a borate salt.

9. The zinc-nickel-silica composite plating bath according to claim 1, comprising no sulfate ions.

10. A plating method comprising:

applying zinc-nickel-silica composite plating to a plating target by using the plating target as a cathode, using zinc, nickel, or both of these as an anode, and using the zinc-nickel-silica composite plating bath according to claim 1.

11. A plating method comprising:

applying zinc-nickel-silica composite plating to a plating target by using the plating target as a cathode, using zinc and nickel as an anode, placing part or all of the zinc anode in an anode chamber partitioned with an ion-exchange membrane, and using the zinc-nickel-silica composite plating bath according to claim 1.

* * * * *